United States Patent [19]

Gati

[11] Patent Number: 4,726,458

[45] Date of Patent: Feb. 23, 1988

[54] DEVICE WITH A SENSOR FOR THE RECOGNITION OF COINS

[76] Inventor: Andras Gati, Textorstrasse 95, D-6000 Frankfurt, Fed. Rep. of Germany

[21] Appl. No.: 887,370

[22] Filed: Jul. 17, 1986

[30] Foreign Application Priority Data

Jul. 24, 1985 [DE] Fed. Rep. of Germany ..... 3526378

[51] Int. Cl.[4] ..... G07D 5/00

[52] U.S. Cl. ..... 194/330; 73/DIG. 4; 310/338

[58] Field of Search ..... 194/328–331, 194/339, 239, 244; 73/163, DIG. 4; 310/328, 330, 331, 332, 338

[56] References Cited

U.S. PATENT DOCUMENTS

| | | | |
|---|---|---|---|
| 1,236,870 | 8/1917 | Reith | 194/330 |
| 3,776,338 | 12/1973 | Johnson | 194/244 |
| 4,485,321 | 11/1984 | Klicker et al. | 73/DIG. 4 |
| 4,577,510 | 3/1986 | Bur et al. | 73/DIG. 4 |

FOREIGN PATENT DOCUMENTS

| | | | |
|---|---|---|---|
| 2168185 | 6/1986 | United Kingdom | 73/163 |

*Primary Examiner*—F. J. Bartuska

*Attorney, Agent, or Firm*—Jeffers, Hoffman & Niewyk

[57] ABSTRACT

A sensor is used for the recognition of coins, which analyses the mintage. The main component of the sensor is a polymeric, elastic material (20) which has piezoelectrical properties. By pressing the minted face of a coin onto the sensory surface (23) a signal is produced corresponding to the high and low points of the mintage, which permits an assessment of the coin by means of the connection of an electronic evaluation unit.

11 Claims, 8 Drawing Figures

DEVICE WITH A SENSOR FOR THE RECOGNITION OF COINS

BACKGROUND OF THE INVENTION

The invention is concerned with a device with a sensor for the recognition of coins, in particular for the grading of authorised and non-authorised coins or for the determination of the coin's value.

Inspection of coins is necessary for example in automatic vending and serving machines for the recognition of a coin's value, as the counter-value should only be supplied against prescribed coins.

The known procedures for the recognition of coins analyse in particular the criteria weight, diameter, thickness and the electrical-magnetic properties of the coin's alloy. It is known that sensors in the form of foils made of polymeric material with piezoelectrical properties are used for the determination of the weight of coins (cf. G. R. Crane in IEEE Transactions on Sonics and Ultrasonics, vol. SU-25, No. 6, November 1978). However, a very large number of coins exist worldwide with approximately the same weight and very similar mechanical and physical characteristics and these are also quite easily obtainable in the era of mass tourism. In addition the forging of the above criteria of coins is simple and cheap.

This leads to the fact that coin checkers usually have to check several criteria for certain recognition of coins and that the individual tolerance limits have to be selected very closely. The device required is thus fairly sophisticated and expensive and liable to faults due to the high precision.

SUMMARY OF THE INVENTION

The objective of the invention is to create a device with a considerably simpler structure than previously, which ensures certain differentiation between authorised and non-authorised coins as well as determination of the coin's value.

This objective is solved in accordance with the invention in that the sensor is a converter consisting of a polymeric, elastic material with piezoelectric properties, such as for example polyvinylidene-fluoride (PVDF), against whose sensory surface the coins are pressable with one minted surface, whereby the impression pattern of the coin's mintage in the sensory surface is convertible by the piezoelectrical effect into the characteristic signal of the coin.

BRIEF DESCRIPTION OF THE DRAWINGS

The above mentioned and other features and objects of the invention, and the manner of attaining them, will become more apparent and the invention itself will be better understood by reference to the following description of an embodiment of the invention taken in conjunction with the accompanying drawings, wherein.

The mintage of a coin is the real criterion for its purity and value. The similarities in this between the various types of coins are extremely rare. The reproduction of the mintage also causes a great effort which decisively reduces the incentive to forge. The invention offers the advantage that a simple sensor suffices to determine the marked differences between the mintages.

Figure 1A:
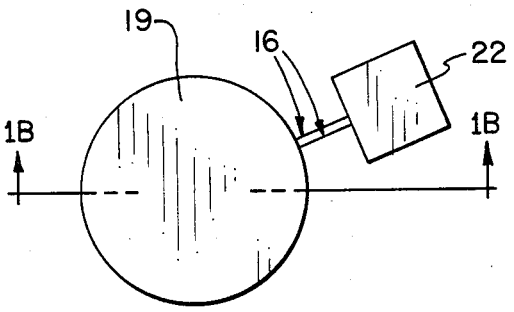
FIG. 1A is a plan view of a coin sensing mechanism according to the present invention.
Figure 1B:
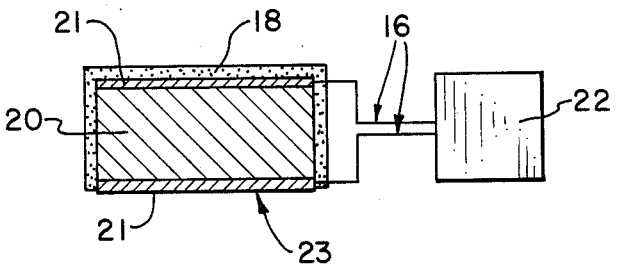
FIG. 1B is a cross sectional view of the coin sensing mechanism of FIG. 1.

FIGS. 1A and B show the assembly in principle of a device in accordance with the invention in plan and cross-section. The main part is a sensor 19 which consists of a polymeric, elastic material 20 which has piezoelectrical properties. An example of such a material 20 is polyvinylidene-fluoride, abbreviated to PVDF. If a mechanical force is applied to this material an electrical voltage is created on its surface which is captured by electrically conducting layers 21 and which can be fed to an electronic evaluation unit 22 in the form of a measurement signal via electrical leads 16. The sensor is enclosed by non-conducting insulation 18 for the purpose of protection.

Figure 2:
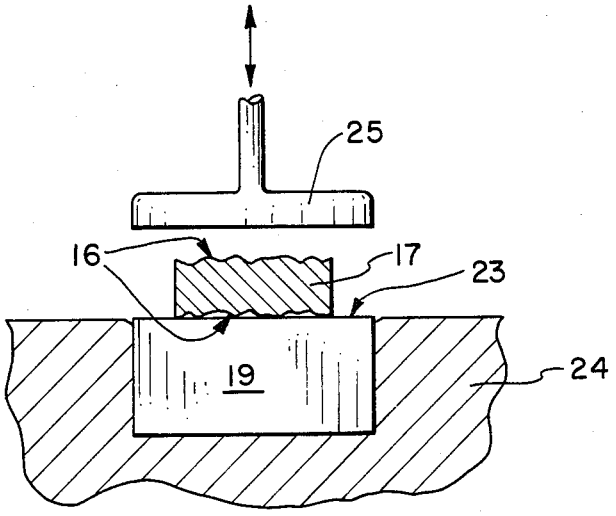
FIG. 2 is a coin sensing mechanism according to the present invention with a coin in position to be pressed against the sensory surface of the sensor.

In the version in accordance with FIG. 2 one minted face 16 of a coin 17 is pressed against the sensory surface 23 of the sensor 19. The high points of the three-dimensional relief caused by minting of the coin come into earlier contact with the sensory surface than the deep points and also penetrate deeper into the coin with an appropriate force. The thus caused impression pattern is converted into a measurement signal by the piezoelectrical effect, whereby the high points of the mintage produce a stronger and/or longer electrical impulse than the low points.

The electrical impulse is evaluated in the electronic evaluation unit as per the criteria intensity and/or variation in time. Equivalent coins are similar in this case whilst differing types or values of coins vary.

Various versions of the device are possible in accordance with the invention. Several are described as examples below.

FIG. 2 shows sensor 19 in a stationary support 24. The coin 17 is guided onto the sensory surface 23 with one minted face 16 and produces the characteristic mintage pattern by its own weight and/or by an additional definite force which is exerted on the coin by a pressure die 25.

Figure 3:
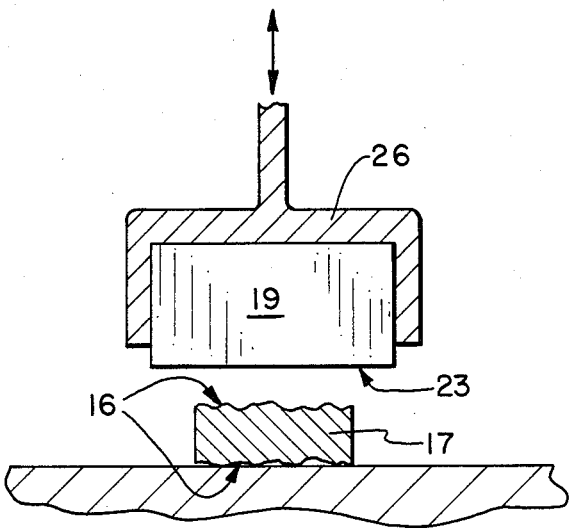
FIG. 3 is a coin sensing mechanism according to the invention with the sensor arranged on the surface of the pressure die.

In FIG. 3 the sensor 19 is arranged on the surface of a pressure die 26 facing towards the coin.

Figure 4:
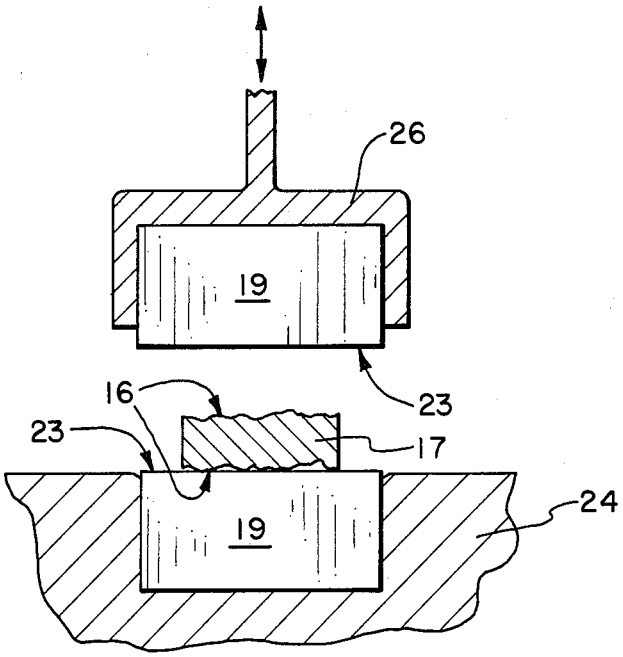
FIG. 4 is another embodiment of the invention including two sensors.

It is illustrated in FIG. 4 how impression patterns can be taken with two sensors 19 simultaneously on two mintage faces 16. In this case two measuring signals are produced which by their combination considerably reduce the probability of similarities with other types and values of coins.

Figure 5:
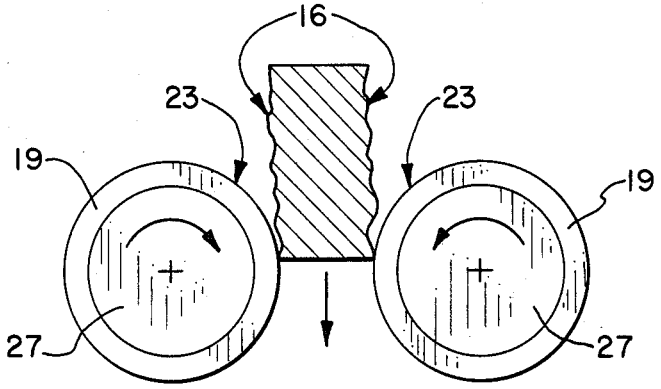
FIG. 5 is another embodiment of the invention with two cylindrical sensors.

FIG. 5 shows two sensors 19, which have the shape of a jacket surface of a straight cylinder, as they are arranged on cylindrical, rotatable holders 27. Other rounded, rollable shapes could also be used for the sensors. The coin mintage 16 to be inspected is rolled over the sensory surfaces in such a way that an impression pattern is caused line by line by the continued rotation of the holder.

Figure 6:
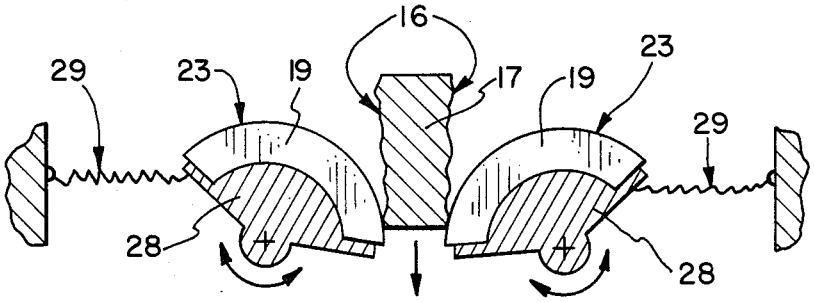
FIG. 6 is another embodiment of the invention with two sensors in the shape of cylinder segments.

FIG. 6 shows two sensors which have, as do their holders, the shape of segments of cylinder jacket surfaces. In this case the mintage faces 16 are also rolled over tangentially. After inspection the holders are brought back to the original position by springs 29. The limited back and forth rotational movement offers the advantage of an uninterrupted lead connection to the sensors.

Figure 7:
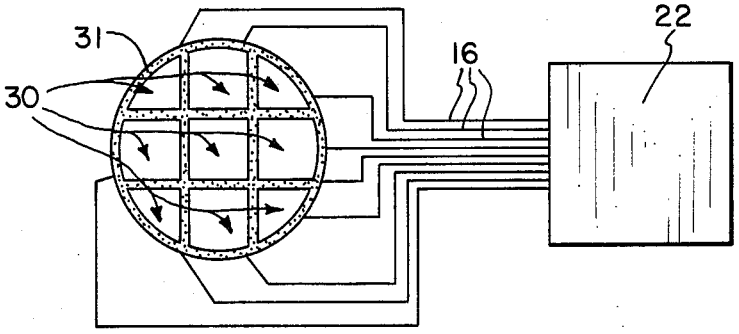
FIG. 7 is another embodiment of the invention wherein the sensor is sub-divided into individual sensory areas.

As illustrated in FIG. 7 the sensory area of the sensor can be sub-divided into individual sensory areas 30 corresponding with a grid. A plan view is shown onto the sensory area with the sensory areas 30 separated by a suitable insulation 31. Apart from the evaluation criteria mentioned above the correspondingly producable, gridded impression pattern can be analysed also by pattern recognition systems by means of geometrical assessment.

Apart from the mintage the weight of the coin can also be determined by the sensor or one of the sensors. For this purpose the coin is guided onto the sensory surface only under the force of its own weight. The strength of the electrical impulse caused can be analysed in the electronic evaluation unit as a dimension for the coin's weight.

The distance covered between the initial position and the pressure testing point by the sensor or sensors or by the pressure die can be used as a dimension for the thickness of the coin as a further additional criterion for the recognition of a pattern.

The adjustment of the testing parameters can be so selected for the stationary testing procedures in accordance with FIGS. 1 through 4 that it is operated either with constant pressure, constant penetration depth of the sensory material into the coin mintage or finally with constant feed and penetration speed up to attainment of the contact pressure end position.

A material test can be carried out by means of the PVDF foil at the same time as the inspection of the mintage image by pulling the coins towards the piezoelectrical sensor by means of a magnet with a certain magnetic force. In this case the electrical signal produced results from the combination of magnetic properties and the mintage of the coins.

Where it is a question of speed and degree of resolution in testing, versions with rotating sensors in accordance with FIGS. 5 and 6 are preferable. The possibility exists here of mounting at least one of the sensors or a back pressure roller foreseen in its place to be movable in such a way that the axis distance between the two rotating parts is alterable. If the gap width between the two sensors or between one sensor and a back pressure roller in the initial position is then selected at the greatest as large as the minimum thickness of a coin to be inspected and if upon the introduction of a coin into the gap, the rotation axes of the two rotating components can be moved apart corresponding with the actual thickness of the coin counter to a restoring force, then the dimension of the axial displacement can be evaluated as a criterion for the thickness of the coin.

It has been shown in practical tests that it is advantageous to arrange two pairs of sensors in accordance with FIGS. 5 and 6 in series, whereby the one pair is at least as wide as the maximum diameter of the coins, whilst the other sensor pair is only very narrow e.g. only a few millimeters. An integral measurement of the two minted faces of the coins can then be carried out with the wide pair of sensors, whereby a characteristic integral signal results for each mintage face, applied over the rolling off angle, which presents a criterion for the size of the coin and the percentual proportion of the raised or deepened areas of the mintage.

The supplementary test carried out with the narrow pair of sensors provides additionally characteristic edge peaks when the sensors roll on and off the coin and a multitude of intermediate peaks. As the first edge peaks in particular are very much larger than the intermediate peaks, it may be recommendable to switch over to a larger signal amplification immediately after the first peak. Apart from this the coin's diameter can be determined from the edge peak spacings and its thickness from their size, so that no further measuring procedures are required for this.

If the coins are tested with a precisely predetermined orientation, e.g. with precisely vertically standing numerals for their value definition, slender sensors which roll over and check only a certain, narrowly limited area of the mintage images, provide in accordance with FIGS. 5 or 6 a very characteristic electrical signal picture with typical edge and intermediate peaks. This characteristic is usually uniform for new as well as worn coins of the same type. If one is prepared to dispense with a previous alignment of the coins which is necessary for this, e.g. with the aid of a sensor in accordance with FIG. 7, then one can also record the multitude of signal images, for each authorised coin in the electronic evaluation unit in advance, which result when a pair of narrow sensors of several millimetres which run over the minted faces of the coin in question in any desired direction. When checking a coin which has not been specially aligned the signal image received will thereupon be checked as to whether it corresponds with one of the signal images received and recorded under various angles of rotation of the coin.

In order to increase the precision, two rotating sensors in accordance with FIGS. 5 or 6 can be used, whose total width is greater than the maximum coin diameter, whose jacket surface is sub-divided into a multitude of narrow, mainly cylindrical jacket surfaces. A characteristic signal curve can then be received of each of these narrow sensor areas in accordance with the area of the coin rolled over by it; hence with a single test procedure a multitude of geometrically assessable information can be analysed with electronic pattern recognition systems.

The sensitivity of the sensors can be affected by the hardness or elasticity of their sensory surfaces. Here it is sufficient to select the non-conducting insulation 18 in accordance with FIG. 1B according to suitable thickness and material elasticity. A thicker insulation 18 of the sensory surface of a stationary or rotating sensor has a stronger effect by nature when testing small surface areas of coins than for an integral test, where the ratio of raised and sunken areas of the mintage image is determined for the whole coin. Further parameters of the signal resolution and sensitivity are the radius of the sensor, the thickness of the sensor material and the elasticity of the carrier and its support.

The invention also offers a very simple possibility of excluding recognition errors on more or less badly worn coins. As the mintages wear out on both sides at the same rate, the ratio of the raised surfaces or sunken surfaces of both sides does not alter, or only very slightly. Thus the quotients of the integral signals or of the signals of certain surface areas of both sides can be determined in the electronic evaluation unit and are a characteristic of a certain type of coin which remains constant even upon progressive wear.

The use of a high ohm voltage booster for amplifying the edge signal and of a charge booster for integral measurement of a coin's mintage have proven useful in practical tests.

What is claimed is:

1. A device for the recognition of coins, in particular for the grading of authorized and non-authorized minted coins having at least one minted surface comprising a converter consisting of a polymeric, elastic material with piezoelectric properties and having a sensory surface, means for pressing a minted surface of a coin against said sensory surface to generate a piezo electrical signal, means for converting the piezoelectrical signal of the impression pattern of the coin's minted surface to establish a characteristic electrical signal for the coin and means for evaluating the electrical signal.

2. Device in accordance with claim 1, wherein said pressing means produces a defined force of the minted surface upon the sensor.

3. Device in accordance with claim 1, wherein the sensor comprises a circumferential surface of a rotatably mounted cylinder and the coin minted surface to be inspected is rollable tangentially to the sensory surface, whereby an impression of the coin's minted surface line by line and a series of piezoelectrical signals are created by the continued rotation of the sensor.

4. Device in accordance with claim 3, including two rounded rotatable guidance components, of which at least one component forms said sensor, said guidance components being separated by a gap in their initial position, said gap being equal to the minimum thickness of the eoin to be inspected, the rotation axis of at least one of the guidance components being laterally movable away from the rotation axis of the other guidance component a distance corresponding to the thickness of the coin.

5. Device in accordance with claim 3, including a plurality of sensors, and wherein at least one sensor scans only a partial area of a coin's minted surface and produces a piezoelectrical signal corresponding thereto, whilst at least one other sensor scans the entire surface of the minted surface of the coin to produce an integral signal corresponding to the entire minted surface.

6. Device in accordance with claim 1, including two opposed sensors whereby two minted surfaces of a coin are simultaneously scannable by insertion of a coin having two minted surfaces therebetween.

7. Device in accordance with claim 1, wherein the sensory surface of the sensor is sub-divided into several sensory areas, so that a gridlike impression pattern of the minted surface of a coin and the piezoelectrical impulses which are generated corresponding to the grid may be evaluated by geometrical assessment.

8. Device in accordance with claim 1, including means for sensing the weight of the coin with the sensor.

9. Device in accordance with claim 3, wherein the distance between certain points at the beginning and end of the piezoelectrical signal are evaluated as a criterion for the diameter of the coin.

10. Device in accordance with claim 3, wherein the size of the peak at the beginning of the piezoelectrical signal is evaluated as a criterion for the diameter of the coin.

11. Device according to claim 1, wherein the sensor forms a cylinder segment.

* * * * *